United States Patent [19]

McFarlin

[11] 4,194,428

[45] Mar. 25, 1980

[54] KEYBOARD MUSICAL INSTRUMENT

[76] Inventor: Bill E. McFarlin, Rte. 1, Box 5, Williston, N. Dak. 58801

[21] Appl. No.: 967,126

[22] Filed: Dec. 7, 1978

[51] Int. Cl.[2] ..... G10C 3/16

[52] U.S. Cl. ..... 84/236; 84/240; 84/243

[58] Field of Search ..... 84/236, 240, 243, 244, 84/246, 247

[56] References Cited

U.S. PATENT DOCUMENTS

| | | | |
|---|---|---|---|
| 962,261 | 6/1910 | Rose et al. | 84/246 |
| 2,950,642 | 8/1960 | Sluyter | 84/236 |
| 3,724,317 | 4/1973 | Rogers | 84/447 |

FOREIGN PATENT DOCUMENTS 609505 8/1926 France .

*Primary Examiner*—Lawrence R. Franklin
*Attorney, Agent, or Firm*—Mawhinney & Mawhinney & Connors

[57] ABSTRACT

A keyboard musical instrument utilizes a magnetic action to strike a resonator element with a hammer in response to playing of a pivotally mounted key, the magnetic action including a pair of opposite polarity magnetic poles mounted on an actuating end of the key and a magnetic pole mounted on the hammer to be disposed in horizontal alignment with one of the poles mounted on the key of an opposite polarity when the hammer is in a rest position such that the opposite polarity magnetic poles attract one another with the hammer in the rest position and, when the playing end of the key is depressed, the similar polarity pole on the actuating end of the key is moved to repel the magnetic pole carried on the hammer to impel the hammer to strike the resonator element. A block of non-magnetic material can extend from the lower magnetic pole on th actuating end of the key under the magnetic pole of the hammer to engage the same and initiate movement of the hammer when the playing end of the key is depressed.

7 Claims, 3 Drawing Figures

FIG. 3
FIG. 1
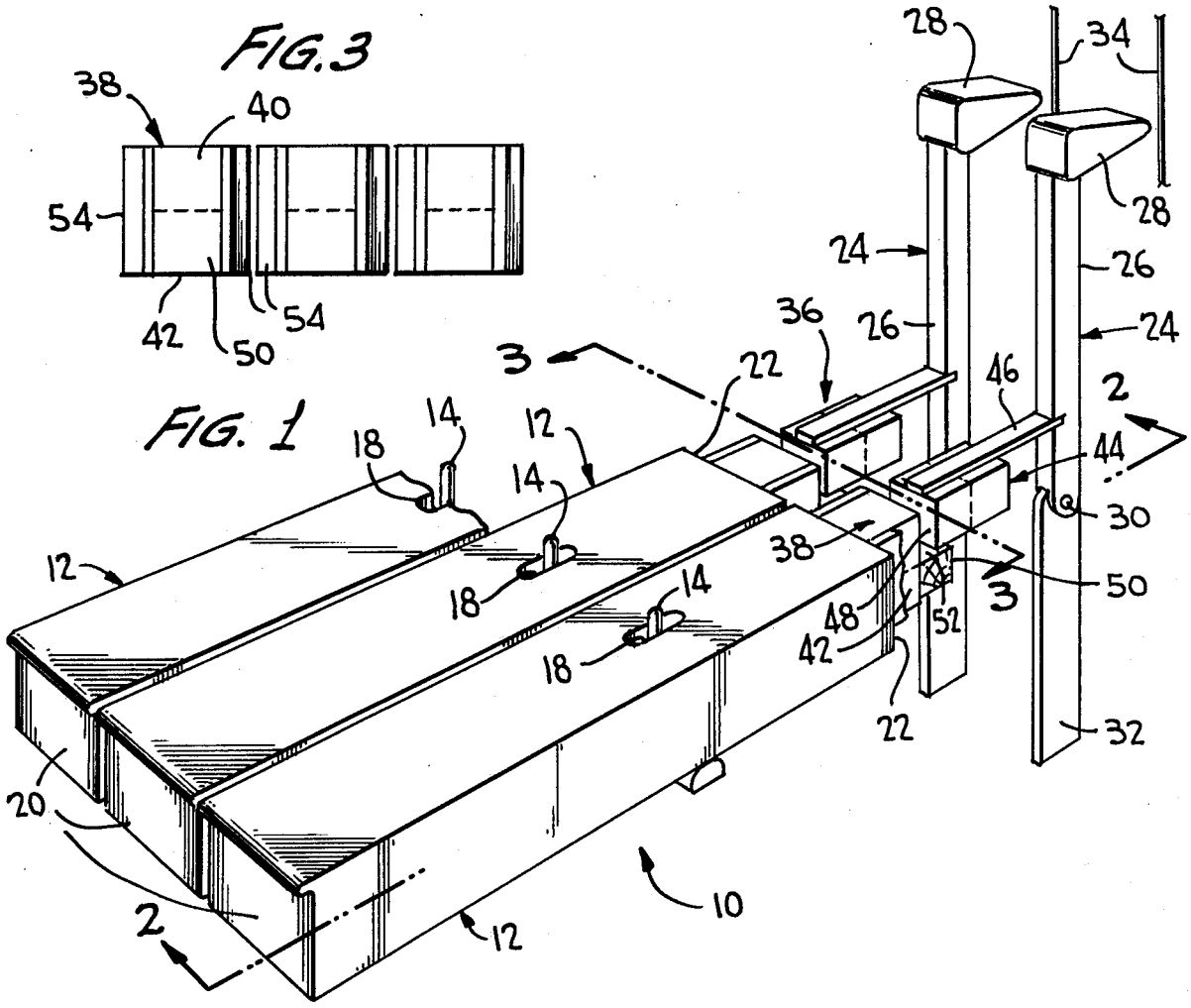
FIG. 2
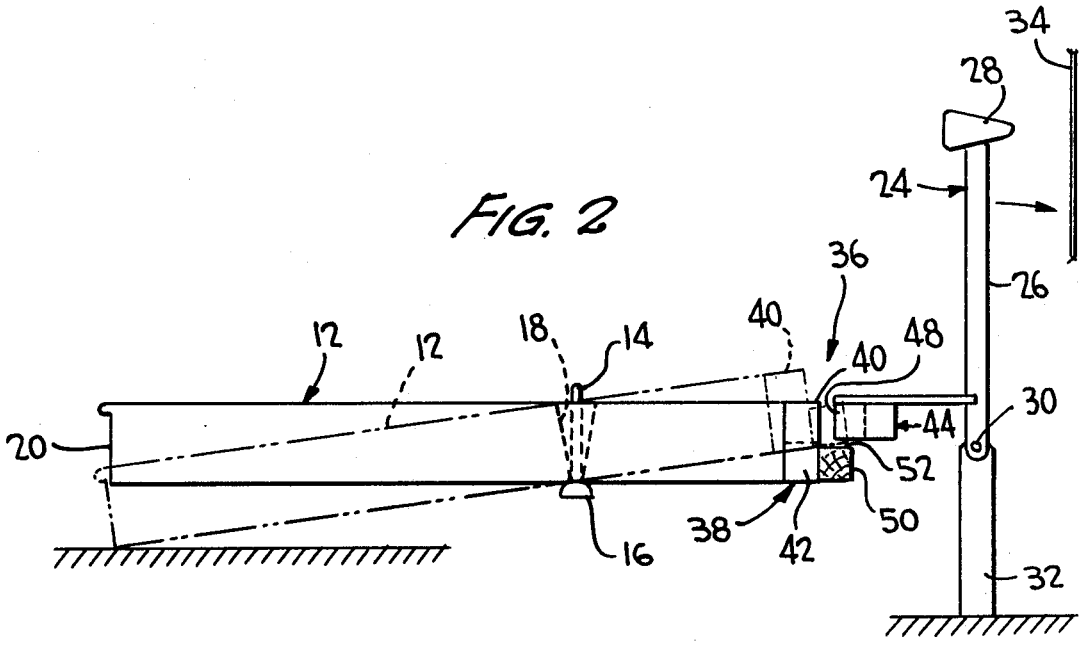

KEYBOARD MUSICAL INSTRUMENT

BACKGROUND OF THE INVENTION

1. Field of the Invention

The present invention pertains to keyboard musical instruments and, more particularly, to a magnetic action for coupling a key with a hammer for striking a resonator element of such keyboard musical instruments.

2. Discussion of the Prior Art

The actions or operating mechanisms required to couple a key of a keyboard musical instrument with a hammer to cause the hammer to strike a resonator element, such as a string in a piano, are normally relatively complex mechanical structures thereby producing increased opportunities for failure and/or malfunction. Many efforts have been made to simplify the coupling between keys and hammers in keyboard musical instruments, such efforts including the use of magnetic actions, as exemplified by U.S. Pat. Nos. 848,658 to Kampelman, 856,794 to Morgan and 3,139,476 to Alvarez. As yet, there is still room for improvement in such coupling actions in that such actions generally have the disadvantages, even when utilizing magnetic actions, of being relatively complex in nature, expensive to produce, difficult to adjust and having many parts subject to failure or malfunction.

SUMMARY OF THE INVENTION

Accordingly, it is a primary object of the present invention to overcome the above-mentioned disadvantages of the prior art by utilizing a simple yet precise magnetic action to couple a key with a hammer in a keyboard musical instrument.

Another object of the present invention is to utilize permanent magnets to couple the actuating end of a key in a keyboard musical instrument with a hammer to precisely impel the hammer to strike a resonator element.

The present invention has an additional object in that a mechanical force is utilized to initiate movement of a hammer in response to movement of a key in a keyboard musical instrument, the mechanical force being coupled with a magnetic force obtained from movement of shielded, permanent magnet poles relative to a magnetic pole carried on the hammer.

Some of the advantages of the present invention over the prior art are that the magnetic action of the present invention is simple and inexpensive to produce, has relatively few moving parts and facilitates adjustment for precise operation.

The present invention is generally characterized in a keyboard musical instrument including a resonator for producing an audible tone, a hammer movable from a rest position in a generally horizontal direction to strike the resonator, a pivotally mounted key having a playing end and an actuating end for operating the hammer, the key being movable when the playing end is depressed to move the actuating end in a substantially vertical direction, and a magnetic action for coupling the actuating end of the key with the hammer including a first magnet mounted on the actuating end of the key having a first pole of a first polarity and a second pole of a second polarity opposite the first polarity, the first and second poles being disposed one above the other, and a second magnet mounted on the hammer having a pole of the second polarity disposed in horizontal alignment with the first pole of the first magnet when the hammer is in the rest position such that the first magnet attracts the second magnet to hold the hammer at the rest position and the first magnet repels the second magnet when the playing end of the key is depressed to align the second pole of the first magnet with the pole of the second magnet whereby the hammer is impelled to strike the resonator when the playing end of the key is moved.

Other objects and advantages of the present invention will become apparent from the following description of the preferred embodiment taken in conjunction with the accompanying drawings.

BRIEF DESCRIPTION OF THE DRAWINGS

FIG. 1 is a broken perspective of a keyboard musical instrument incorporating a magnetic action in accordance with the present invention.

FIG. 2 is a view taken along line 2—2 of FIG. 1 illustrating operation of the keyboard musical system magnetic action in phantom.

FIG. 3 is a view taken along line 3—3 of FIG. 1.

DESCRIPTION OF THE PREFERRED EMBODIMENT

A keyboard musical instrument 10, such as a piano, according to the present invention is illustrated in FIG. 1 and includes a plurality of keys 12 pivotally mounted on a frame, not shown, via upright pins 14 mounted on a horizontal bar 16, each of the pins 14 extending through a passage 18 in one of the keys 12 such that the keys rock or pivot about bar 16. Each of the keys has a playing end 20 on one side of the pivotal mounting and an actuating end 22 on the opposite side of the pivotal mounting such that a downward depression of the playing end 20 of each key causes upward movement of the actuating end 22 of the key.

The keys 12 each operate a hammer 24 formed of an upright leg 26 carrying a head 28 at its upper end and pivotally mounted via a pin 30 on a support 32 carried on the frame of the keyboard musical instrument. The hammers 24 are pivotal to cause each of the heads 28 to strike a resonator element 34, such as a taut string of a piano.

Each of the keys 12 is coupled with one of the hammers 24 by means of a magnetic action generally indicated at 36 including one or more permanent magnets 38 mounted on the actuating end 22 of each key to define a magnetic pole 40 vertically disposed above a magnetic pole 42, the magnetic poles 40 and 42 being of opposite polarity such that the poles can be formed with a single permanent magnet for simplicity. A permanent magnet 44 is carried on an arm 46 cantilevered from the leg 26 of each hammer 24 with the permanent magnet 44 arranged such that a magnetic pole 48 thereof is disposed in horizontal alignment with the upper pole 40 of magnet 38 when the key 12 is in a rest position, as shown in full lines in FIG. 2. The magnetic pole 48 has a polarity opposite the polarity of magnetic pole 40 such that a magnetic attraction is produced therebetween to maintain each hammer 24 in a position with its head 28 spaced from resonator element 34 when its corresponding key is in the rest position. A block 50 made of nonmagnetic material, such as wood, extends from the actuating end 22 of each key under the magnet 44 and the block 50 has an upper surface covered with a felt material 52. All of the permanent magnets 38 and 44 have metal shields 54 mounted on the sides thereof to prevent magnetic flux from each magnetic action 36 from adversely effecting operation of an adjacent magnetic action, the metal shields being made of any suitable material, such as galvanized iron or the like.

In operation, the keys 12 along the keyboard of the musical instrument 10 are normally in a rest position, as illustrated in FIG. 2, such that the magnetic pole 40 of magnet 38 is in horizontal alignment with the opposite magnetic pole 48 of magnet 44, the magnetic attraction therebetween producing a counterclockwise force on hammer 24, looking at FIG. 2, to maintain the head 28 of the hammer at a position spaced from the resonator element 34. When the playing end 20 of one of the keys 12 is depressed, the pivotal movement of the key causes the actuating end to move upward, as illustrated in dashed lines in FIG. 2, thereby causing the block 50 to engage the magnet 44 and initiate movement of the hammer clockwise toward the resonator element 34. The upward movement of the actuating end of the key 12 also moves the magnetic pole 42 into horizontal alignment with the same polarity magnetic pole 48 once the block 50 has moved past the edge of the magnet 44 thereby magnetically repelling the magnet away from the actuating end of the key to impel the head 28 of the hammer to strike the resonator element 34, the head naturally rebounding from the resonator element to return to a position adjacent the actuating end of the key which, when returned to its reset position, attracts the magnet 44 due to the opposite polarities of magnetic poles 40 and 48 thereby returning the hammer to its initial position.

The magnetic structure of the magnetic action 36 according to the present invention can be formed in any suitable manner, preferably utilizing permanent magnets due to the simple construction permitted thereby, the permanent magnets being arranged in any manner desired, such as, for example, using a single permanent magnet 38 having a positive pole 40 and a negative pole 42 and a single magnet 44 having a negative pole 48.

While the hammer 24 has been described in simplified fashion as formed of a single, pivotally mounted upright leg 26, it will be appreciated that any hammer mechanism or linkage can be used with the present invention as long as it includes a member carrying a magnet and movable in a generally horizontal direction to operate other elements to strike a resonator element. Accordingly, the present invention can be used with hammer mechanisms or linkages of complex natures for use with various types and styles of keyboard musical instruments.

Inasmuch as the present invention is subject to many variations, modifications and changes in detail, it is intended that all subject matter discussed above or shown in the accompanying drawings be interpreted as illustrative and not in a limiting sense.

What is claimed is:

1. A keyboard musical instrument comprising resonator means for producing an audible tone;

hammer means movable from a rest position in a generally horizontal direction to strike said resonator means;

pivotally mounted key means having a playing end and an actuating end for operating said hammer means, said key means being movable when said playing end is depressed to move said actuating end in a substantially vertical direction; and magnetic action means for coupling said actuating end of said key means with said hammer means including first magnet means mounted on said actuating end of said key means having a first pole of a first polarity and a second pole of a second polarity opposite said first polarity, said first and second poles being disposed one above the other, and second magnet means mounted on said hammer means having a pole of said second polarity disposed in horizontal alignment with said first pole of said first magnet means when said hammer means is in said rest position such that said first magnet means attracts said second magnet means to hold said hammer means at said rest position and said first magnet means repels said second magnet means when said playing end of said key means is depressed to align said second pole of said first magnet means with said pole of said second magnet means whereby said hammer means is impelled to strike said resonator means when said playing end of said key means is moved.

2. A keyboard musical instrument as recited in claim 1 wherein said poles of said first and second magnet means are formed by permanent magnets.

3. A keyboard musical instrument as recited in claim 1 wherein said magnetic action means includes a block of non-magnetic material extending from said actuating end of said key means to engage said hammer means and initiate movement of said hammer means when said playing end of said key means is moved.

4. A keyboard musical instrument as recited in claim 1 wherein said first pole of said first magnet means is disposed over said second pole of said first magnet means and said magnetic action means includes a block of non-magnetic material extending from said second pole under said second magnet means to engage said second magnet means and initiate movement of said hammer means when said playing end of said key means is depressed downwardly to move said actuating end of said key means upwardly.

5. A keyboard musical instrument as recited in claim 4 wherein said poles of said first and second magnet means are formed by permanent magnets and said magnetic action means includes metal magnetic shielding means carried on the sides of said permanent magnets.

6. A keyboard musical instrument as recited in claim 5 wherein said block of non-magnetic material has an upper surface covered with a felt material.

7. A keyboard musical instrument as recited in claim 6 wherein said block of non-magnetic material is made of wood.

* * * * *